United States Patent [19]

Isobe et al.

[11] Patent Number: 4,458,643

[45] Date of Patent: Jul. 10, 1984

[54] LUBRICATING OIL FEEDING DEVICE FOR FUEL INJECTION PUMPS

[75] Inventors: Hiroshi Isobe; Yuji Shimamune; Kouji Yamanoi, all of Higashimatsuyama, Japan

[73] Assignee: Diesel Kiki Co., Ltd., Tokyo, Japan

[21] Appl. No.: 473,234

[22] Filed: Mar. 8, 1983

[30] Foreign Application Priority Data

Mar. 9, 1982 [JP] Japan ..... 57-32722[U]

[51] Int. Cl.[3] ..... F01M 1/06

[52] U.S. Cl. ..... 123/196 R; 123/495

[58] Field of Search ..... 123/495, 196 R; 417/499; 184/6.5

[56] References Cited

U.S. PATENT DOCUMENTS

| | | | |
|---|---|---|---|
| 2,010,696 | 8/1935 | L'Orange | 123/196 R |
| 2,410,947 | 11/1946 | Johnson | 123/495 |
| 4,198,948 | 4/1980 | Conrad et al. | 123/495 |

FOREIGN PATENT DOCUMENTS

| | | | |
|---|---|---|---|
| 957948 | 12/1947 | France | 123/196 R |
| 145307 | 12/1980 | German Democratic Rep. | 123/495 |

OTHER PUBLICATIONS

Bosch-pamphlet VDT-AKP 1/1, first edition, Dec. 1971, pp. 26 and 27.

*Primary Examiner*—Magdalen Y. C. Moy

*Attorney, Agent, or Firm*—Frishauf, Holtz, Goodman & Woodward

[57] ABSTRACT

A connecting member, preferably in the form of a bolt, is mounted in a wall portion of the pump housing of a fuel injection pump, which defines therein a chamber in which component parts to be lubricated are accommodated, or a space communicating therewith, and which connects the tail end of a lubricating oil feeding pipe to the pump housing. The connecting member has a cylinder bore within which a piston is received with a predetermined small clearance between the cylinder bore and the piston and which communicates with the above chamber or space. The piston is moved in response to a change in the relationship between the pressure of lubricating oil acting upon the piston and the urging force of a spring urging the piston against the oil pressure, to prevent clogging of the above clearance with sludge or the like present in the lubricating oil.

6 Claims, 2 Drawing Figures

LUBRICATING OIL FEEDING DEVICE FOR FUEL INJECTION PUMPS

BACKGROUND OF THE INVENTION

This invention relates to fuel injection pumps for internal combustion engines, and more particularly to a lubricating oil feeding device for use with such injection pump, which is capable of avoiding clogging of its lubricating oil feeding passage with sludge or the like contained in the lubricating oil.

An in-line type fuel injection pump used in general in Diesel engines is constructed such that each of the plungers has its lower end disposed in contact with a tappet via a lower spring seat on which a plunger return spring is seated, and the tappet has a roller disposed in camming engagement with the camming peripheral surface of a camshaft rotatable in synchronism with rotation of the output shaft of an engine associated with the pump. With this arrangement, as the camshaft rotates, the plunger is reciprocatingly moved within its plunger barrel to carry out suction and delivery of fuel.

The camshaft is accommodated within a cam chamber which is supplied with lubricating oil to lubricate sliding parts such as the camshaft and its peripheral parts. A conventional lubricating oil feeding arrangement is such that a lubricating oil feeding bore is formed in the pump housing, which opens in a bore in which the tappet slides so that lubricating oil fed into the bore is delivered into the cam chamber through a clearance between the inner wall of the bore and the tappet. The sliding motion of the tappet prevents clogging of the lubricating oil passage with sludge or a like substance in the lubricating oil, which permits setting the interior diameter of the lubricating oil passage at a desired value so as to enable the supply of lubricating oil at a moderate flow rate.

However, there may be a case where the lubricating oil feeding bore cannot be provided in the peripheral wall of the bore in which the tappet slides, depending upon the configuration of the fuel injection pump applied, the shape or size of the space in which the pump is to be mounted, etc. In such case, it has conventionally been employed to form a lubricating oil feeding bore in the peripheral wall of the cam chamber to supply lubricating oil directly into the chamber. According to this method, the interior diameter of the lubricating oil feeding bore has to be set at a large value so as to avoid clogging of the bore with sludge or the like. As a consequence, an excessive amount of lubricating oil can be supplied to the injection pump so that the plunger sucks part of the lubricating oil in the pump and delivers it together with fuel.

SUMMARY OF THE INVENTION

It is an object of the invention to provide a lubricating oil feeding device for use in a fuel injection pump, which permits setting the flow rate of lubricating oil being supplied at a moderate value, without the possibility of clogging of its lubricating oil feeding passage with sludge or the like in the lubricating oil.

It is a further object of the invention to provide a lubricating oil feeding device for use in a fuel injection pump, which can be mounted at an optional suitable location in the pump, thus providing a wide range of positional choices in mounting the fuel injection pump onto an engine.

It is another object of the invention to provide a lubricating oil feeding device for use in a fuel injection pump, which is simple in construction and low in cost.

The present invention provides a lubricating oil feeding device which comprises: a lubricating oil supply source; a lubricating oil feeding pipe for guiding lubricating oil supplied under pressure from the supply source; a connecting member mounted in a wall portion of the pump housing of a fuel injection pump and connecting the oil feeding pipe to the above wall portion of the pump, the connecting member having a cylinder bore formed therein; first communication means communicating the interior of the oil feeding pipe with the cylinder bore of the connecting member; second communication means communicating the cylinder bore with a chamber in the pump, accommodating pump component parts to be lubricated, or a space communicating therewith; a piston slidably received within the above cylinder bore and having a diameter slightly smaller than the interior diameter of the cylinder bore, the piston being disposed to be acted upon by the pressure of lubricating oil introduced into the cylinder bore through the first communication means; and urging means having a spring urging the piston against the pressure of the introduced lubricating oil and compressible by the same oil pressure. When lubricating oil is delivered under pressure from the lubricating oil supply source, the piston is slidingly moved by the pressure of the introduced lubricating oil in a direction of the spring being compressed and the introduced lubricating oil is forced to travel through a small clearance between the cylinder bore and the piston, and through the second communication means and then fed into the aforementioned chamber or space in the pump, and when the pressure delivery of lubricating oil is interruped, the piston is slidingly moved by the force of the spring in a direction of the spring being expanded. The sliding movement of the piston prevents clogging of the above small clearance between the cylinder bore and the piston, with sludge or the like in the lubricating oil.

The above and other objects, features and advantages of the invention will be more apparent from the ensuing detailed description taken in connection with the accompanying drawings.

DETAILED DESCRIPTION

Figure 1:
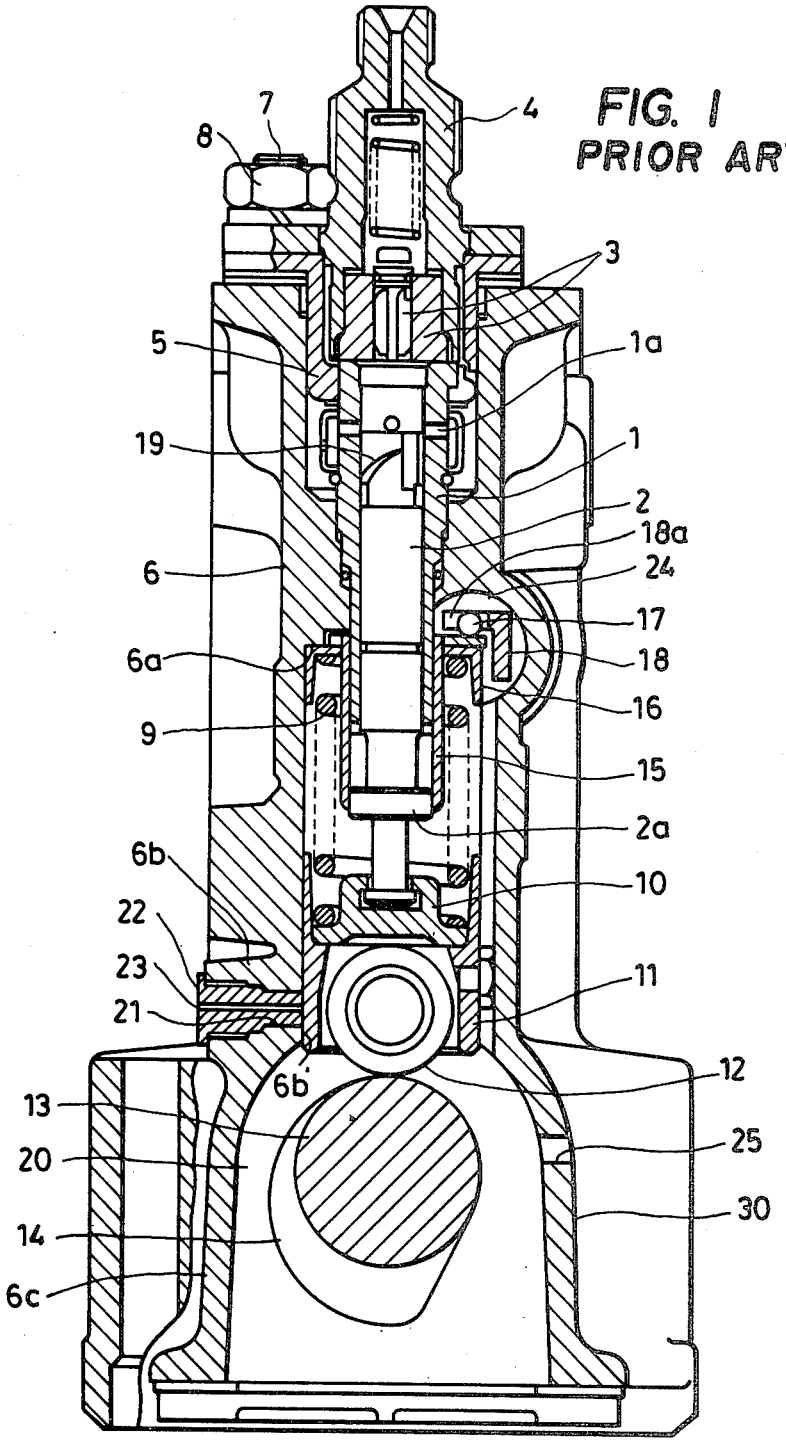
FIG. 1 PRIOR ART
FIG. 1 is a longitudinal sectional view of an in-line type fuel injection pump equipped with a conventional lubricating oil feeding device.

Referring to FIG. 1, there is illustrated a typical in-line type fuel injection pump generally used in large-sized Diesel engines. An element holder 5 supports a pump element formed of a plunger barrel 1 and a plunger 2 received therein, and a delivery valve 3 and a delivery valve holder 4 supporting the valve 3. The element holder 5 is secured in a pump housing 6 by means of a bolt 7 and a nut 8. The plunger 2 has its lower end engaging a lower spring seat 10 on which a plunger return spring 9 is seated, and which is supported by a tappet 11 carrying a roller 12 disposed in camming contact with the camming peripheral surface 14 of a camshaft 13 which is rotatable in unison with rotation of the crankshaft of an engine, not shown, associated with the pump. Rotation of the camshaft 13 causes a reciprocating motion of the tappet 11 within its bore 6b', which in turn causes a reciprocating motion of the plunger 2 within the plunger barrel 1 to carry out suction and delivery of fuel in a known manner. A control sleeve 15 is fitted on lower part of the plunger barrel 1, and an upper spring seat 16, on which an upper end of the plunger return spring 9 is seated, is fitted on an upper end of the control sleeve 15 and held against a stepped shoulder 6a of the pump housing 6 by the plunger return spring 6. A control rack 18 having an L-shaped cross section is fitted through a hole 24 formed in a wall portion of the pump housing 6, and a ball 17 secured on an upper end face of the control sleeve 15 is fitted in a corresponding one of slots 18a formed in the control rack 18. The control sleeve 15 has its lower end engaging a lower end portion 2a of the plunger 2 for rotation in unison with each other. Thus, by moving the control rack 18 along its axis, the control sleeve 15 engaging same via the ball 17 fitted in the slot 18 is rotated to rotate the plunger 2 to cause a change in the relative position between a helix 19 on the wall of the plunger and an intake port 1a formed in the plunger barrel 1, resulting in a change in the effective stroke of the plunger 2.

The camshaft 13 is accommodated within a cam chamber 20 which is defined by a peripheral wall portion 6c of the pump housing 6 which is continuous from an upper peripheral wall portion 6b defining the bore 6b' along which the tappet 11 slides. The peripheral wall portion 6b is formed therein with a through hole 21 in which is threadedly fitted a plug member 22 formed therein with a lubricating oil feeding bore 23 having a small interior diameter. Lubricating oil delivered under pressure from an oil pump, not shown, is forced to travel through the oil feeding bore 23 and a gap between the peripheral wall portion 6b and the tappet 11 to be fed into the cam chamber 20 to lubricate the component parts such as the camshaft and its related parts, and then delivered into a governor chamber, not shown, through the rack-inserting hole 24 communicating with the cam chamber 20, to lubricate the governor component parts. Further, the lubricating oil in the cam chamber 20 is discharged through an outlet port 25 and returned to an oil tank, not shown. The lubricating oil is recirculated in the above manner.

According to the above-described arrangement wherein lubricating oil is fed to the cam chamber through the small gap between the peripheral wall portion 6b of the pump housing and the tappet, the sliding motion of the tappet along the peripheral wall impedes clogging of the oil feeding bore 23 with sludge or the like in the lubricating oil, as previously noted, which makes it possible to set the interior diameter of the oil feeding bore 23 at a moderately small value so as to ensure the supply of lubricating oil at a moderately small flow rate, e.g. 1 l/hr. However, according to this conventional oil feeding arrangement, it is not possible to always provide the oil feeding bore 23 in the peripheral wall portion 6b along which the tappet 11 slides, depending upon the configuration of the fuel injection pump and the size and shape of the pump-mounting space, as previously noted. In the event where the oil feeding bore 23 cannot be formed in the tappet-sliding peripheral wall portion 6b, it has conventionally been employed to mount a connecting bolt in the fuel injection pump at a suitable location such as in a peripheral wall portion defining the cam chamber to connect the oil feeding pipe to the pump in such a manner that lubricating oil in the oil feeding pipe is delivered directly into the cam chamber through an oil feeding bore axially extending through the connecting bolt. To avoid clogging of this oil feeding bore with sludge or the like, its interior diameter needs to be set at a value of from 1–0.8 mm at minimum. However, with this value of interior diameter, the resulting flow rate of lubricating oil will be too large, e.g. 30 l/hr or more, causing suction and delivery of lubricating oil in the pump by the plunger, as mentioned previously.

Figure 2:
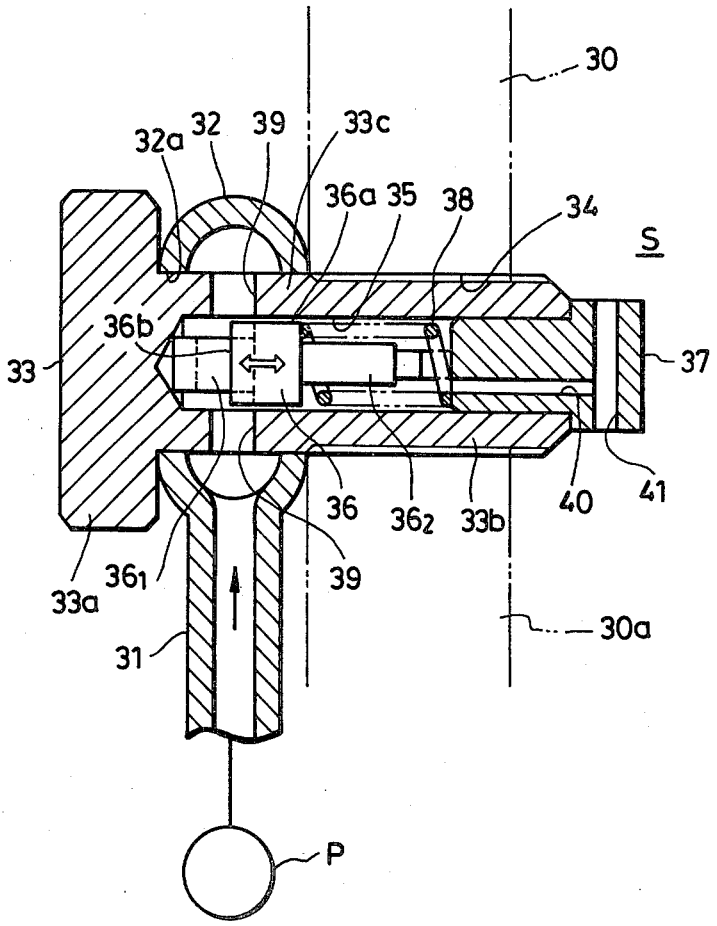
FIG. 2 is a sectional view illustrating an embodiment of the lubricating oil feeding device according to the present invention.

FIG. 2 illustrates an embodiment of the lubricating oil feeding arrangement according to the present invention. The device of the present invention is applicable to fuel injection pumps including the in-line type shown in FIG. 1, and is intended to be mounted in the pump housing 30 at a suitable and mountable portion of same defining therein a space S such as a cam chamber or a governor chamber or a space communicating therewith. The present device includes a lubricating oil feeding pipe 31 which communicates at one end with an oil pump P and formed at its other end with an eyed portion 32 in the form of a hollow annulus, and a connecting bolt 33 connecting the oil feeding pipe 31 to the pump housing 30. The connecting bolt 33 may be formed by an ordinary bolt having an enlarged end portion or head 33a, and has its other end portion 33b threadedly fitted in a fitting threaded hole 34 formd in a wall portion 30a of the pump housing 30. Fitted on a portion 33c of the bolt 33 exposed to the outside from the wall portion 30a of the pump housing 30 is the eyed portion 32 of the oil feeding pipe 31, which has a central opening 32a penetrated by the bolt 33 and is supportedly interposed between the enlarged end portion 33a of the bolt 33 and the wall portion 30a of the pump housing 30, to thus connect the oil feeding pipe 31 to the injection pump through the bolt 33. The connecting bolt 33 is formed therein with a cylinder bore 35 in the form of a blind hole, axially extending from its tip face to the enlarged end portion 33a. Slidably received within this cylinder bore 35 is a piston 36 which has a main body 36a having a diameter slightly smaller by a predetermined amount than the interior diameter of the cylinder bore 35 so that there exists a predetermined slight clearance c between the inner peripheral wall of the cylinder bore 35 and the outer peripheral wall of the main body 36a. The cylinder bore 35 has an opening facing the space S in which is force fitted an end member 37 against which bears a coil spring 38 which is compressedly interposed between this end member 37 and the main body 36a of the piston 36 in a manner urging an opposed end face of the same body 36a. The above exteriorly exposed portion 33c of the bolt 33 is formed with a pair of through bores 39 and 39 diametrically opposite each other and communicating the interior of the hollow eyed portion 32 of the oil feeding pipe 31 with the interior of the cylinder bore 35. The axial positions of these through holes 39, 39 relative to the cylinder bore 35 are set such that the piston 36 will not close these through holes 39, 39 even when it is positioned in urging contact with the bottom face of the cylinder bore 35. In the illustrated embodiment, they are located such that the diametrical centers of the through holes 39, 39 substantially align with a pressure applying end face 36b of the main body 36 of the piston 36. The piston 36 has opposite end portions $36_1$ and $36_2$ with smaller diameters, which are adapted to be in urging contact, respectively, with the bottom face of the cylinder bore 35 and the inner end face of the end member 37, to serve as stoppers limiting the movable stroke of the piston 36.

The end member 37 is formed therein with an axial through bore 40 arranged eccentrically with respect to the axis of the piston 36 and opening in its inner end face and a radial bore 41 intersecting with the axial bore 40 and opening in the space S so that the bores 40, 41 cooperatively guide lubricating oil from the cylinder bore 35 into the space S. The eccentricity of the axial bore 41 is such that it is not closed by tip of the end portion $36_2$ of the piston 36 when it is brought into contact therewith as the piston 36 is moved toward the end member 37 by the pressure of lubricating oil acting upon the end face **36*b* of the piston 36 against the force of the spring 38**.

The operation of the lubricating oil feeding device of the invention is as follows: The oil pump P feeds under pressure lubricatin oil into the oil feeding pipe 31 and the oil fed in the pipe 31 to the eyed portion 32 at the tail end of the pipe is introduced via the through holes 39, 39 into the cylinder bore 35 to act upon the end face **36*b* of the main body 36*a* of the piston 36. Thus, the piston 36 is moved in a direction of the spring 38 being compressed, while simultaneously the oil is forced to pass through the predetermined small clearance c between the cylinder bore 35 and the main body 36*a* of the piston 36 and then guided through the bores 40, 41 in the end member 37 into the space S of the injection pump. The lubricating oil thus lubricates the component parts within the space S, i.e. the cam chamber or the governor chamber, and hence is discharged through an outlet port, not shown, similar to the one 25 in FIG. 1 to be returned to the oil tank, not shown. During operation of the oil pump, this cycle is repeated. When the pressure feeding of lubricating oil is interrupted, the oil pressure acting upon the pressure applying end face 36*b* of the piston 36 decreases to zero so that the piston is returned to its original position toward the bottom of the cylinder bore 35 by the force of the spring 38. Due to the sliding motion of the piston 36 described above, any sludge or a like substance caught in the clearance c between the cylinder bore 35 and the piston 36** is expelled from the clearance c to prevent clogging of the clearance.

The device according to the invention, which is simply formed by a machined bolt and constructed above, can be mounted on a fuel injection pump at any other desired locations besides the tappet sliding peripheral wall portion of an in-line type fuel injection pump, providing a wide range of choices of locations of the fuel injection pump on an engine. Further, since the clearance c between the cylinder bore and the piston can be easily set at a moderately small value, the flow rate of the lubricating oil passing through the clearance can be set at 1 l/hr or less, as small as that obtained by the device of FIG. 1 which feeds oil through the tappet sliding portion, eliminating the possibility that the pump plunger sucks and delivers lubricating oil filling the pump.

Variations to the described embodiment will occur to those skilled in the art within the scope of the present inventive concepts which are delineated by the following claims.

What is claimed is:

1. In a fuel injection pump including a pump housing having a wall portion defining therein a chamber accommodating component parts of said pump requiring oil lubrication or a space communicating with said chamber, a lubricating oil feeding device comprising: a lubricating oil supply source; a lubricating oil feeding pipe for guiding lubricating oil supplied under pressure from said lubricating oil supply source; a connecting member mounted in said wall portion of said pump housing of said fuel injection pump and connecting one end of said lubricating oil feeding pipe to said wall portion, said connecting member having a cylinder bore formed therein; first communication means communicating the interior of said lubricating oil feeding pipe with said cylinder bore of said connecting member; second communication means communicating said cylinder bore with said chamber or said space of said pump housing; a piston slidably received within said cylinder bore and having a diameter slightly smaller than the interior diameter of said cylinder bore, said piston being disposed to be acted upon by the pressure of lubricating oil introduced into said cylinder bore through said first communication means; and urging means having a spring urging said piston against the pressure of said introduced lubricating oil and compressible by the same oil pressure; whereby when said lubricating oil supply source is operative to supply under pressure lubricating oil, said piston is slidingly moved in said cylinder bore by the pressure of said introduced lubricating oil, in a direction of said spring being compressed and said introduced lubricating oil is forced to travel through a small clearance between said cylinder bore and said piston, and through said second communication means, and then fed into said chamber or said space in said pump housing, and when the pressure supply of lubricating oil is interrupted, said piston is slidingly moved by the force of said spring in a direction of said spring being expanded, thereby preventing clogging of said small clearance between said cylinder bore and said piston, with sludge or a like substance in the lubricating oil.

2. A lubricating oil feeding device as claimed in claim 1, wherein said connecting member comprises a bolt having an enlarged end portion, said bolt being threadedly fitted in said wall portion of said pump housing in a manner cooperating with said wall portion to support said one end of said lubricating oil feeding pipe interposed between said enlarged end portion of said bolt and said wall portion of said pump housing.

3. A lubricating oil feeding device as claimed in claim 1, wherein said first communication means comprises a hollow annular portion forming said one end of said lubricating oil feeding pipe and fitted on said connecting member, and at least one through hole formed in said connecting member and communicating the interior of said hollow annular portion with the interior of said cylinder bore.

4. In a fuel injection pump including a pump housing having a wall portion defining therein a chamber accommodating component parts of said pump requiring oil lubrication or a space communicating with said chamber, a lubricating oil feeding device comprising: a lubricating oil supply source; a lubricating oil feeding pipe for guiding lubricating oil supplied under pressure from said lubricating oil supply source; a connecting member mounted in said wall portion of said pump housing of said fuel injection pump and connecting one end of said lubricating oil feeding pipe to said wall portion, said connecting member having a cylinder bore formed therein and having one end opening in said chamber or said space of said pump housing; communication means communicating the interior of said lubricating oil feeding pipe with said cylinder bore of said connecting member; an end member fitted in said one end of said cylinder bore, said end member having a first hole axially extending and arranged eccentrically with respect to the axis of said piston, and a second hole radially extending and intersecting with said first hole, said first and second holes cooperating to communicate the interior of said cylinder bore with said chamber or said space of said pump housing; a piston slidably received within said cylinder bore and having a diameter slightly smaller than the interior diameter of said cylinder bore, said piston including a main body disposed to be acted upon by the pressure of lubricating oil introduced into said cylinder through said communication means bore and a stopper projected from said main body at least toward said end member and having a smaller diameter than said main body, said first hole opening in an end face of said end member facing said stopper at such a radial location as not to be closed by said stopper; and urging means having a spring urging said piston against the pressure of said introduced lubricating oil and compressible by the same oil pressure; whereby when said lubricating oil supply source is operative to supply under pressure lubricating oil, and piston is slidingly moved in said cylinder bore by the pressure of said introduced lubricating oil, in a direction of said spring being compressed and said introduced lubricating oil is forced to travel through a small clearance between said cylinder bore and said piston, and through said first and second holes in said end member, and then fed into said chamber or said space in said pump housing, and when the pressure supply of lubricating oil is interrupted, said piston is slidingly moved by the force of said spring in a direction of said spring being expanded, thereby preventing clogging of said small clearance between said cylinder bore and said piston, with sludge or a like substance in the lubricating oil.

5. A fuel injection pump as claimed in claim 1, which comprises an in-line type including a camshaft rotatable in unison with rotation of an internal combustion engine associated with said pump, and a plurality of pump plungers disposed for reciprocating motions in unison with rotation of said camshaft.

6. A fuel injection pump as claimed in claim 5, wherein said chamber of said pump housing accommodates said camshaft.

* * * * *

UNITED STATES PATENT AND TRADEMARK OFFICE

CERTIFICATE OF CORRECTION

PATENT NO. : 4,458,643

DATED : July 10, 1984

INVENTOR(S) : Hiroshi ISOBE et al

It is certified that error appears in the above-identified patent and that said Letters Patent is hereby corrected as shown below:

COLUMN 7, last line, after "lubricating oil,", the word "and" should read --said--.

Signed and Sealed this

*Ninth* Day of *April 1985*

[SEAL]

*Attest:*

DONALD J. QUIGG

*Attesting Officer* *Acting Commissioner of Patents and Trademarks*